US006116750A

United States Patent [19]

Hentz

[11] Patent Number: 6,116,750

[45] Date of Patent: Sep. 12, 2000

[54] RECESSED DOWNLIGHT SHOWER FIXTURE

[75] Inventor: Joseph A. Hentz, Crawfordsville, Ind.

[73] Assignee: NSI Enterprises, Inc., Atlanta, Ga.

[21] Appl. No.: 09/168,361

[22] Filed: Oct. 7, 1998

[51] Int. Cl.[7] ..... F21S 8/02; F21V 15/00

[52] U.S. Cl. ..... 362/148; 362/147; 362/267

[58] Field of Search ..... 362/148, 149, 362/150, 267, 145, 147, 101, 457, 364; D26/74

[56] References Cited

U.S. PATENT DOCUMENTS

| | | | |
|---|---|---|---|
| D. 347,292 | 5/1994 | Roos et al. | D26/118 |
| 2,511,937 | 6/1950 | Natale | 362/267 |
| 2,582,659 | 1/1952 | Tamminga | 362/267 |
| 3,557,361 | 1/1971 | McCarty | 362/267 |
| 3,617,733 | 11/1971 | Adams | 362/267 |
| 4,128,865 | 12/1978 | Johnson | 362/369 |
| 4,130,120 | 12/1978 | Kohler, Jr. | 607/80 |
| 4,450,512 | 5/1984 | Kristofek | 362/147 |
| 4,485,430 | 11/1984 | Achiaga Fustel | 362/267 |
| 5,440,471 | 8/1995 | Zadech | 362/147 |
| 5,758,959 | 6/1998 | Sieczkowski | 362/148 |
| 5,944,412 | 8/1999 | Janos et al. | 362/148 |

FOREIGN PATENT DOCUMENTS

| | | | |
|---|---|---|---|
| 2253045 | 8/1992 | United Kingdom | 362/267 |

*Primary Examiner*—Cassandra Spyrou
*Assistant Examiner*—John Juba, Jr.
*Attorney, Agent, or Firm*—Kenneth E. Darnell

[57] ABSTRACT

A lighting fixture intended for mounting in a relationship with a shower stall for illumination of the shower stall, the fixture of the invention particularly taking the form of a recessed downlight fixture mounted above the ceiling of a shower stall or the like with light from the fixture entering the shower stall through an opening formed in the shower ceiling surmounted by the fixture. In this extremely wet location, a finishing trim of the fixture acts not only to cover the ceiling opening but also to provide means for preventing moisture capable of damaging electrical components of the fixture from coming into contact with said components. The finishing trim acts in concert with sealing structure which can take the form of gaskets, flexible bellows or the like to comprise the means for preventing potentially damaging moisture contact with said electrical components in certain embodiments of the invention. In a preferred embodiment of the invention, however, the finishing trim acts in concert with a lamp, particularly an indoor/outdoor lamp or lamp rated for moisture contact, to restrict the ability of moisture, especially in the form of splash, to move through an otherwise apparently open pathway existing between opposing surfaces of the lamp and of the finishing trim, such a restricted pathway acting to prevent contact of moisture with said electrical components.

6 Claims, 5 Drawing Sheets

RECESSED DOWNLIGHT SHOWER FIXTURE

BACKGROUND OF THE INVENTION

1. Field of the Invention

The invention relates to lighting fixtures useful in a wet location and particularly a shower, the invention preferably taking the form of a recessed downlighting fixture mountable above the shower ceiling.

2. Description of the Prior Art

Lighting is difficult to provide in shower enclosures without the use of lensed fixtures due to the inadvisability of using typical lamps and electrical components of lighting fixtures in wet locations. In spite of potential dangers inherent in contact between water and energized electrical components, other safety considerations have led to a recognition that a certain level of lighting be present in a shower or shower enclosure in order to promote the safe use of showers. While commercially available lighting systems have long been known for use in wet environments, such systems do not find use in shower enclosures due in part to aesthetic reasons. Aesthetically pleasing lighting fixtures such as are typically considered appropriate for homes and the like are not generally safe for use in wet environments. Accordingly, difficulties have previously been encountered in the art in providing a lighting fixture for a wet location and particularly for a shower enclosure or the like wherein the fixture is capable of safe operation within the shower environment while providing a pleasing appearance comparable to the lighting provided in remaining portions of a home or the like. Lighting fixtures which can be recessed into the ceiling in both new construction and in retrofit situations have become useful within the relatively recent past, the utility of these "downlighting" fixtures having become known in a variety of lighting situations due in part to the unobtrusive nature of the fixtures and to the level of illumination which can be provided by such fixtures. Downlighting fixtures are typically mounted above a ceiling to ceiling support structure such as joists or to a gridwork supporting a suspended ceiling installation. In conventional mounting of downlighting fixtures, a mounting frame is provided which is mounted to joists or to a suspended ceiling gridwork above the ceiling itself, a junction box being carried by the mounting frame and being connected to a source of electrical power through conduit extending from the junction box to a connection with a lamp housing. Conventional downlighting fixtures often incorporate a reflector trim or finishing trim mounted within the lamp housing, the trim often carrying an electrical socket which mounts lamping of appropriate type and wattage. It is possible to use a reflector trim as the lamp housing. Installation of the recessed lighting fixture is thus provided between joists of a ceiling or to elements of a suspended ceiling. Typical ceilings are formed of plasterboard, plaster, ceiling tile or the like, and hide virtually all of the recessed lighting fixture. Light from the lamping of the fixture can thus be directed into an environmental space below the ceiling through an opening formed in the ceiling, the fixture being placed immediately above the opening such that lamping is disposed in immediate proximity to the opening with light directly emanating from the lamping and being reflected into the environmental space by reflection from the reflector trim. Light is thus directed substantially downwardly into the environmental space which is to be illuminated. Recessed downlighting fixtures take a variety of forms including one particularly suitable fixture useful according to the teachings of the present invention, this fixture being described in U.S. Pat. No. 5,690,423, the disclosure thereof being incorporated hereinto by reference. Due to the fact that a recessed downlighting fixture such as is described in the aforesaid patent can be mounted above a ceiling with only lower portions of a reflector trim or finishing trim extending from a hole in the ceiling to cover the hole and further with lamping being preferably disposed within or slightly above the opening in the ceiling, such recessed lighting fixtures are unobtrusive and exhibit pleasing appearance while providing substantial illumination levels. A long-felt need in the art for a shower light having a pleasing appearance combined with operational safety is thus met by the present invention through the provision of a recessed downlighting fixture having lamping rated for wet locations, such as an indoor/outdoor PAR (parabolic aluminized reflector) lamp or similar lamp wherein contact with water with "glass" portions of the lamp does not cause breakage of the lamp or any other unsafe condition. In a downlighting fixture, such relatively unattractive lamping is only seen over an arcuate surface which is typically located lowermost on the lamp in most installed situations. In other words, a recessed downlighting fixture fitted with an indoor/outdoor PAR lamp or similar lamp will have an appearance which is as pleasing as conventional downlighting which utilizes more conventional lamping. The invention therefore particularly envisions a recessed downlighting fixture fitted with appropriate "waterproof" lamping such as an indoor/outdoor PAR lamp of appropriate wattage for use in shower enclosures and the like, such a fixture being capable of safe operation while exhibiting a pleasing appearance and providing desirable levels of illumination within the shower enclosure. The invention further envisions the provision of means for preventing moisture capable of damaging electrical components of the fixture from coming in contact with said components. The finishing trim of the downlighting fixture is particularly chosen to act in concert with sealing structure which takes the form of gaskets, flexible bellows or the like to comprise the means for preventing potentially damaging moisture contact with such electrical components in certain embodiments of the invention. In a preferred embodiment of the invention, however, the finishing trim acts in concert with the lamping itself, particularly an indoor/outdoor lamp or lamp rated for moisture contact, to restrict the ability of moisture, especially in the form of splash, to move through an otherwise apparently open pathway existing between opposing surfaces of the lamp and of the finishing trim, such a restricted pathway acting to prevent contact of moisture with said electrical components. The advantages of the invention are realized with economies of manufacture, installation and use.

SUMMARY OF THE INVENTION

The invention provides a lighting fixture capable of producing desirable illumination levels within a shower enclosure or the like without hazard to a user of the shower enclosure or to the lighting fixture itself. The lighting fixtures of the invention in the several embodiments thereof produce desirable illumination levels while providing a pleasing appearance. The lighting fixtures of the invention can particularly take the form of recessed downlighting fixtures mountable above an opening in a shower ceiling, the fixture including structure in several forms which prevent moisture capable of damaging electrical components of the fixtures from coming in contact with said components. A reflector trim or finishing trim configured according to several embodiments of the invention include sealing structure between interior surfaces of said trim and exterior surfaces of suitable lamping such as indoor/outdoor PAR 30 or PAR 38 lamping of desirable wattages, as examples.

One embodiment of the invention utilizes a sealing structure taking the form of a gasket, grommet or portion of a grommet to seal that space between interior surfaces of a reflector trim or finishing trim and exterior surfaces of a suitable lamp. The sealing structure thus prevents water present in a shower from passing into interior portions of the lighting fixture, such as between the trim and lamp, which water might otherwise contact electrical components of the fixture such as a socket element to which the lamp is mounted to be driven by electrical power.

In an alternate embodiment, a flexible bellows is disposed within that space between a reflector trim or finishing trim and exterior surfaces of a lamp, lower perimetric portions of the bellows extending into contact with surfaces of the lamp to block passage of moisture in the space between the trim and the lamp so that such moisture cannot contact electrical components such as a socket element which mounts the lamp.

In a preferred embodiment of the invention, an indoor/outdoor lamp such as a PAR 30 or PAR 38 lamp rated for contact with moisture including liquid water is mounted substantially within a reflector trim or finishing trim, the diameter of the lamp being only slightly less than the diameter of the opening in the trim so that ingress of moisture into that space between interior surfaces of the trim and exterior surfaces of the lamp is restricted. Any water entering the relatively thin annulus between the trim and the lamp does not reach water-sensitive electrical components such as mount the lamp at the proximal end thereof due to deflection of the water between the inner surfaces of the trim and the outer surfaces of the lamp. In essence, water which may enter the annulus between the trim and the lamp formed between those portions of the trim and the lamp which extend into or are disposed adjacent to the interior of a shower enclosure or the like cannot retain sufficient momentum against gravity to reach and contact electrical components such as are mounting the lamp and thus create a hazard.

In the embodiments of the invention, a reflector trim or finishing trim assembly would usually include a lamp socket mountable to the trim, the lamp socket mounting a lamp for energization of the lamp, the assembly thus formed being easily and rapidly mounted within the interior of a lamp housing or can of a downlighting fixture or similar lighting fixture. Clip structure such as is disclosed in U.S. Pat. No. 5,707,143, the disclosure of which is incorporated hereinto by reference, attaches the reflector trim or finishing trim into the lamp housing or can without the use of tools, thereby allowing the trim to be installed at a job site. The trim further fits snugly against a ceiling surface and about a ceiling hole through which light is directed into a shower enclosure. Structure forming a part of a downlighting fixture assembly, such as the clip of U.S. Pat. No. 5,707,143 "snugs" the trim against the ceiling to prevent a gap from existing between the trim and the ceiling, thus preventing light leakage and providing a clean appearance while preventing water entry into the opening cut in the ceiling through which light is directed into the interior of the shower enclosure.

Accordingly, it is a primary object of the present invention to provide a lighting fixture capable of being used in association with a shower enclosure or the like to provide desirable illumination levels within the interior of the shower enclosure, the illumination function being provided without hazard to a user of the shower enclosure or to the lighting fixture itself.

It is another object of the invention to provide a recessed downlighting fixture mountable above the ceiling of a shower enclosure or the like, the fixture having a reflector trim or finishing trim within which a suitable lamp operable under wet conditions is mounted, means being provided in association with the trim and the lamp to prevent moisture capable of damaging electrical components of the fixture from contacting said components.

A further object of the invention is to provide a recessed downlighting fixture or the like for use in association with a shower enclosure or the like to provide a desired level of illumination within the shower enclosure, the fixture comprising means for preventing potentially damaging contacts between moisture and electrical components of the fixture, thereby enabling use of the lighting fixture in association with the shower enclosure without hazard to a user of the enclosure or to the lighting fixture itself.

Further objects and advantages of the invention will become more readily apparent in light of the following detailed description of the preferred embodiments.

DESCRIPTION OF THE PREFERRED EMBODIMENTS

Co-pending U.S. patent application Ser. No. 08/686,669, filed Jul. 26, 1996, and assigned to the assignee of the present application, is incorporated hereinto by reference, the patent application describing a lamp housing or can such as is useful with the present invention to form a downlighting fixture. U.S. patent application Ser. No. 08/690,314, filed Jul. 25, 1996, and assigned to the assignee of the present application, is incorporated hereinto by reference, the patent application describing bar hanger assemblies capable of mounting a downlighting fixture above a ceiling either between joists or to structure forming a suspended ceiling. U.S. Pat. No. 5,690,423, referred to hereinabove and incorporated hereinto by reference, discloses a downlighting fixture and particularly a wire frame pan such as can conveniently comprise a recessed downlighting fixture useful according to the present invention. U.S. Pat. No. 5,662,414 is incorporated hereinto by reference and describes another downlighting fixture and pan for such a fixture which can be used according to the invention to carry out the objects and advantages of the invention. U.S. Pat. No. 5,707,143 is incorporated hereinto by reference and discloses a clip capable of mounting a reflector trim or finishing trim within a lamp housing or can of a downlighting fixture, such structure being useful according to the invention. The disclosures of the aforementioned co-pending United States patent applications and issued United States patents are incorporated hereinto by reference.

Figure 1:
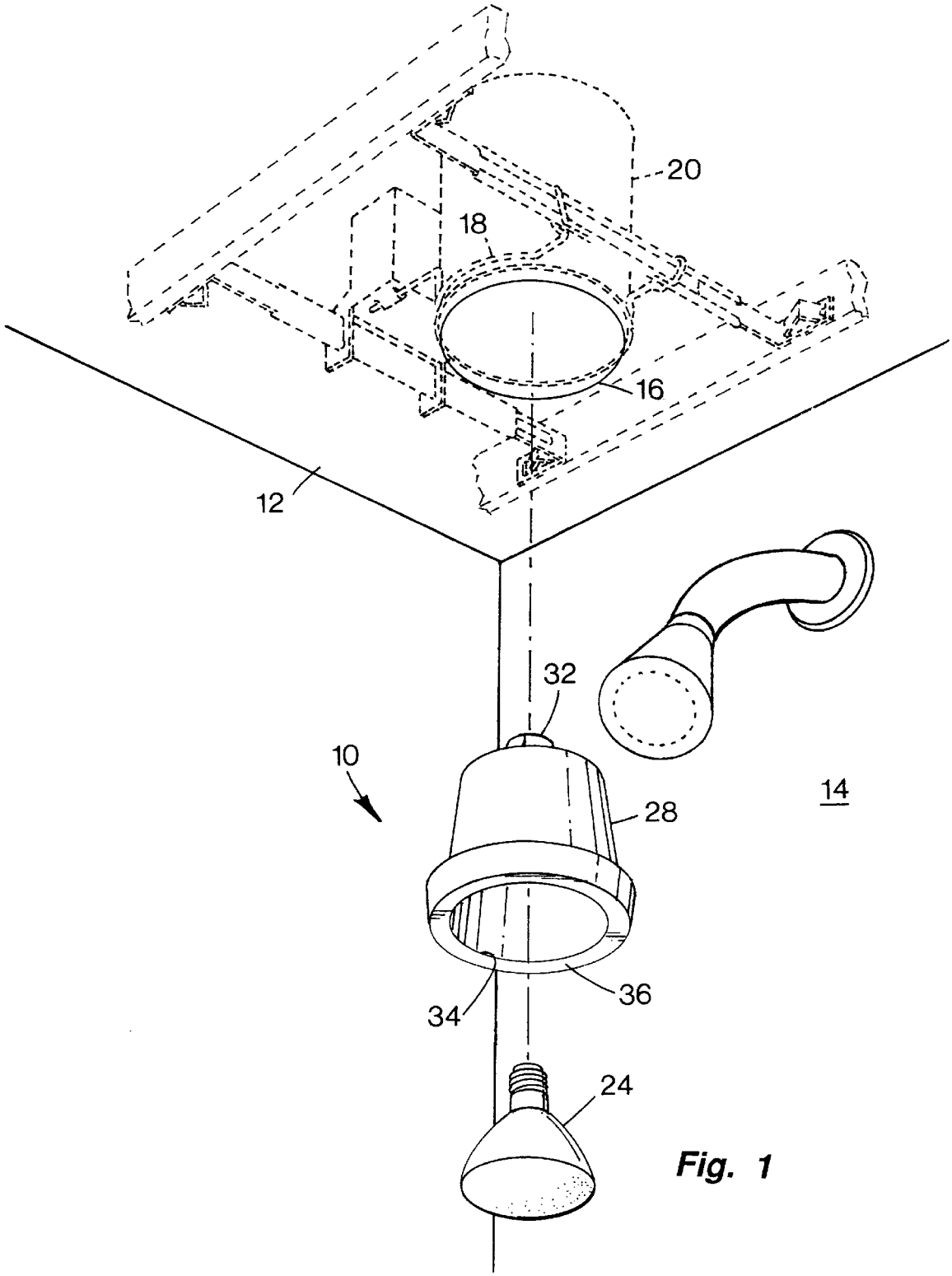
FIG. 1 is an exploded assembly view in perspective of a lighting fixture conformed according to the invention and mounted above a ceiling of a shower enclosure.
Figure 2:
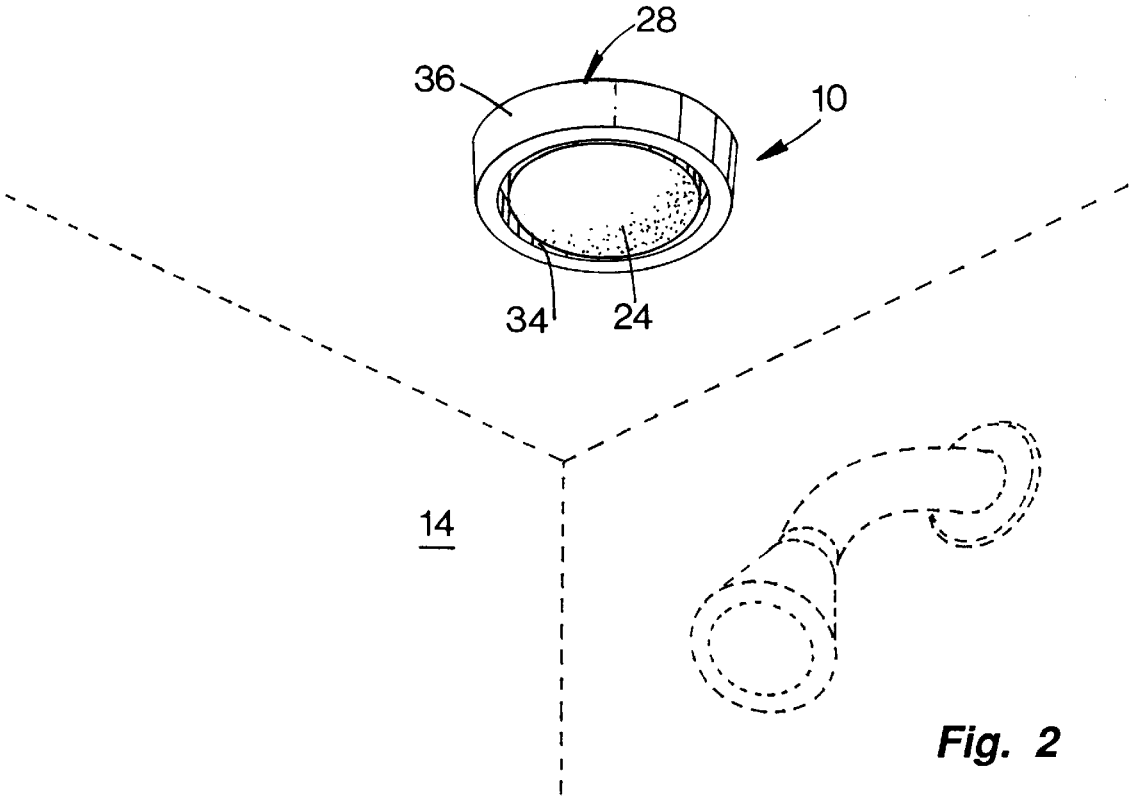
FIG. 2 is a perspective view taken from interiorly of the shower enclosure illustrating those portions of the lighting fixture which either extend into or are disposed immediately adjacent to the shower enclosure and which communicate with the interior of the shower enclosure.
Figure 3:
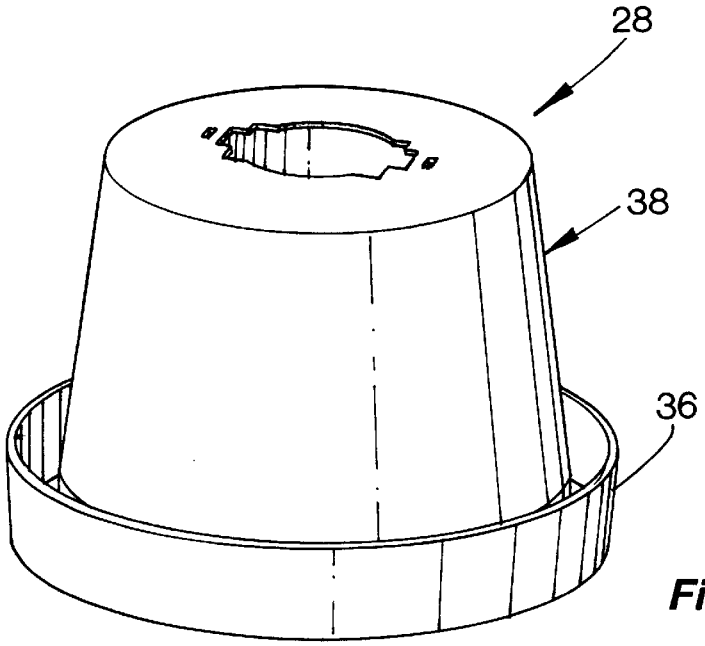
FIG. 3 is a perspective view of a finishing trim or reflector trim which is particularly useful according to the invention.

Referring now to the drawings and particularly to FIGS. 1 and 2, a lighting fixture seen generally at 10 in FIG. 1 to be in the process of installation above ceiling 12 of a shower enclosure 14, the ceiling 12 having an opening 16 formed therein through which opening 16 light can be directed into the interior of the shower enclosure 14 by means of the lighting fixture 10. The lighting fixture 10 is particularly chosen according to the invention to comprise a recessed downlighting fixture formed of a supporting pan 18 such as is described in U.S. Pat. No. 5,690,423, referred to hereinabove, the pan 18 preferably mounting a can 20 as is conventional in the art and a junction box 22, these components being conventional in a recessed downlighting fixture. The can 20 can be rated for insulation contact or for non-insulation contact applications or can be an insulation contact/non-insulation contact can such as is described in pending U.S. patent application Ser. No. 08/686,669, filed Jul. 26, 1996, and assigned to the assignee of the present invention, as is referred to hereinabove. A lamp 24 is normally mounted within the confines of the can 20 and is seen best in FIG. 2 to have primary light emitting portions thereof disposed adjacent to the interior of the shower enclosure and communicating with the enclosure through the opening 16, light being directed through the opening 16 into the interior of the shower enclosure 14. The lamp 24 is preferably taken to be an indoor/outdoor PAR lamp such as PAR 30 and PAR 38 lamps of either short neck or long neck designations. The lamp 24 must be rated for use in wet environments and should have a bulb diameter, preferably at a distal end of the lamp which is slightly less than the inner diameter of an opening 26 formed in a trim 28. The trim 28 can be either a reflector trim or a finishing trim, these kinds of trims conventionally performing both reflective and finishing functions. A lighting fixture such as the lighting fixture 10 can be configured without the use of the can 20 with the trim 28 itself essentially forming the housing within which the lamp 24 is mounted. The trim 28 is preferably mounted within the can 20 by means of clips (not shown) such as are disclosed in U.S. Pat. No. 5,707,143 as referred to hereinabove. The clips (not shown) are attached to the trim 28 by means of cooperating openings in the top of the trim 28, the openings being shown in FIG. 3. The functioning of the clips with the openings in the trim shown in FIG. 3 is described in U.S. Pat. No. 5,707,143. An electrical socket 32 is to be mounted within a central aperture in a top wall of the trim 28 by means of clips such as the clips 34 seen in FIG. 4 inter alia, the socket 32 mounting the lamp 24 for electrical energization in a conventional manner.

FIG. 2 particularly shows those portions of the lighting fixture 10 which would be visible from the interior of the shower enclosure, a flange 36 formed around perimetric annular edges of the trim 28 and about an opening 34 of the trim 28 fits up against the ceiling 12 to cover the opening 16 formed in the ceiling 12. As aforesaid, the lamp 24 fits into the interior of the trim 28 and connects to the socket 32, lowermost curved portions of the lamp 24 extending into the opening 34 or being disposed immediately above said opening so that light is directed from the fixture 10 through the opening 34 of the trim 28. The flange 36 can be U-shaped in section or can be otherwise configured. The main body 38 of the trim 28 is preferably frusto-conical in shape. The dimensions of the trim 28 and the dimensions of the lamp 24 are preferably chosen such that the diameter of the opening 34 is only slightly greater than the diameter of the portion of the lamp 24 which extends into or is disposed immediately above the opening 34 in the trim 28.

Figure 4:
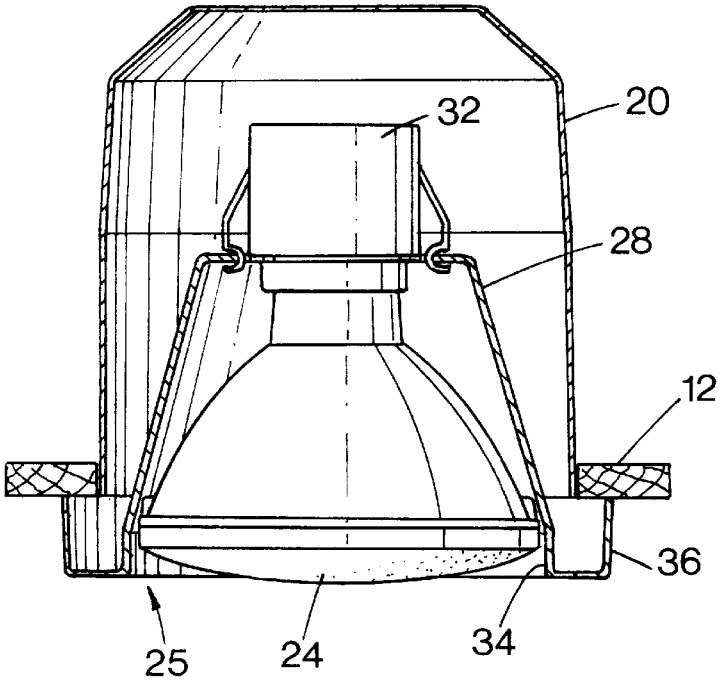
FIG. 4 is a side elevational view in section of a trim according to the invention and having a socket element and a lamp mounted by the socket element retained by the trim.
Figure 5:
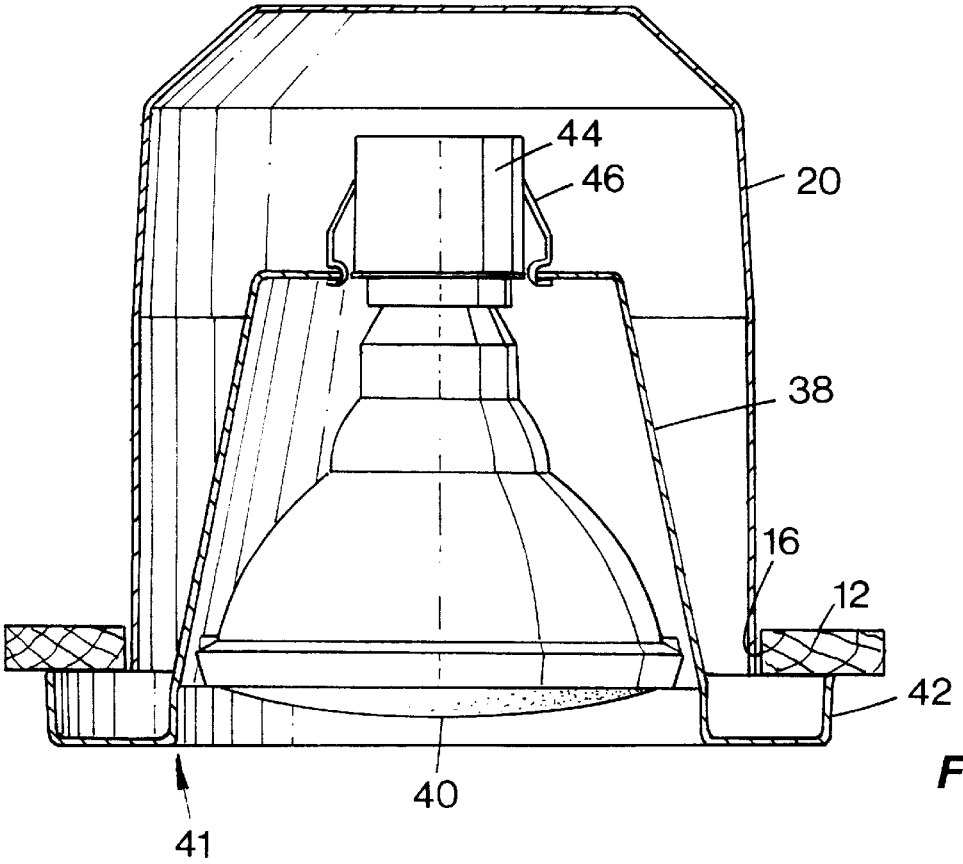
FIG. 5 is a side elevational view in section of another embodiment of trim useful according to the invention.

As is seen in FIGS. 4 and 5, trim such as the trim 28 as seen in FIG. 4 and the trim 38 as seen in FIG. 5, can be of differing sizes depending upon the size of the lamp employed. In FIG. 4, the lamp 24 is a PAR 30SN lamp while lamp 40 received within the trim 38 of FIG. 5 preferably comprises a PAR 38 lamp or a PAR 30LN lamp. Flange 42 of the trim 38 is seen to be wider than the flange 36 of the trim 28, the dimensions being employed to cover a ceiling opening of larger diameter when the trim 38 is employed. Reference to FIG. 5 also illustrates the use of a socket 44 mounted to an upper planar wall of the trim 38 by means of clips 46 in a manner essentially identical to that described previously herein.

As is best seen in FIGS. 4 and 5, the diameter of the respective lamps 24 and 40 is only slightly less than the diameter of the respective openings defined by the respective flanges 36 and 42 of the trims 28 and 38. This relatively small, open annulus seen respectively at 25 and 41 between the respective lamps 24, 40 and the respective trims 28, 38, acts as a "bottleneck" to passage of liquid water in the form of "splash" or droplets or the like between said lamps and said openings of said trims, vertical momentum of such moisture once past these "bottlenecks" becoming very quickly reduced by gravity such that the moisture does not enter into the interior of the respective trims 28 and 38 to a degree which allows damaging contact between the moisture and electrical components such as the respective sockets 32 and 44. Portions of the lamps 24 and 40 themselves and interior walls of the trims 28 and 38 thus provide means for preventing potentially damaging moisture contact with electrical components of the fixture 10 by restricting the ability of moisture, especially in the form of splash and droplets, to move through an otherwise apparently open pathway existing between opposing surfaces of the respective lamps 24, 40 and the respective trims 28, 38, such a restricted pathway acting to prevent contact of the moisture with electrical components located more interiorly of the fixture 10. Lamp heat may also contribute to minimizing such contact by vaporizing the moisture. Hazard to a user of the shower enclosure as well as to the lighting fixture 10 per se is thereby reduced.

Figure 6:
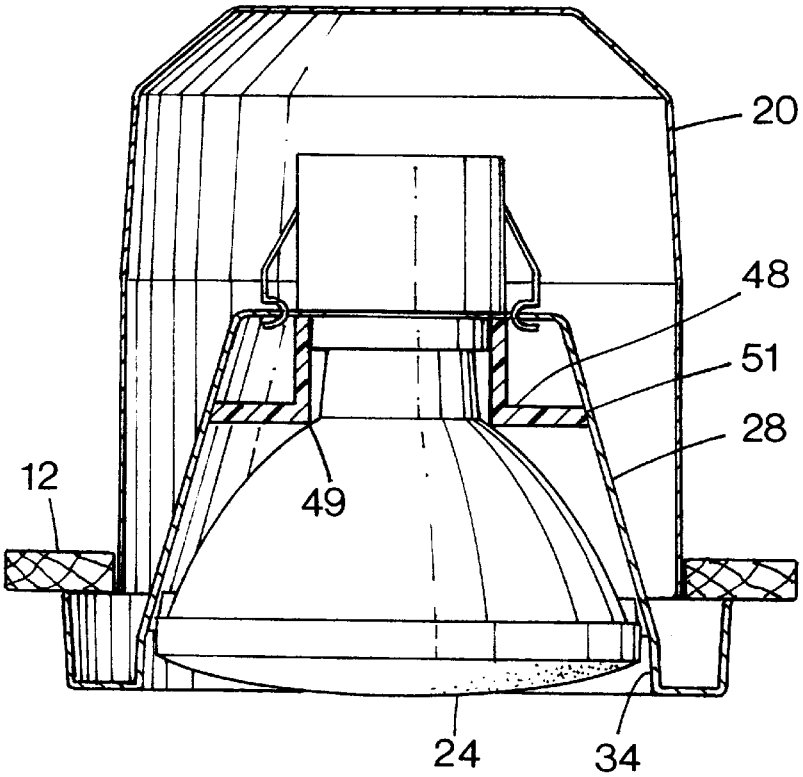
FIG. 6 is a side elevational view in section of a trim useful according to the invention and having a lamp mounted therein, the drawing further illustrating the use of a sealing structure which seals spacing between the trim and the lamp to prevent moisture from contacting electrical components such as components which mount the lamp for electrical energization.
Figure 9:
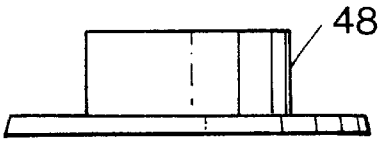
FIG. 9 is a side elevational view of one-half of a standard elastomeric grommet which has been cut in two in order to produce a sealing structure useful according to the invention; and, FIG. 10 is a side elevational view of a flat washer which can be fitted between interior surfaces of trim and exterior surfaces of a lamp to seal therebetween and prevent moisture from moving into interior portions of the lighting fixture to contact water-sensitive electrical components.

Referring now to FIG. 6, a sealing structure seen to comprise a portion of a grommet 48 such as is best seen in FIG. 9 is employed to further resist movement of moisture into the interior of a reflector trim or a finishing trim according to the invention. In FIG. 6, the trim is essentially identical to the trim 28 of FIG. 4 and the lamp of FIG. 6 is essentially identical to the lamp 24 of FIG. 4. The grommet 48 is formed by cutting a conventional grommet in half with a central opening of the grommet fitting over the lamp 24 with inner perimetric edges 49 of the grommet 48 formed about said opening contacting exterior surfaces of the lamp 24. Outer perimetric edges 51 of the grommet 48 contact interior wall surfaces of the trim 28 and therefore produce a sealing function between the lamp 24 and the interior of the trim 28.

Figure 7:
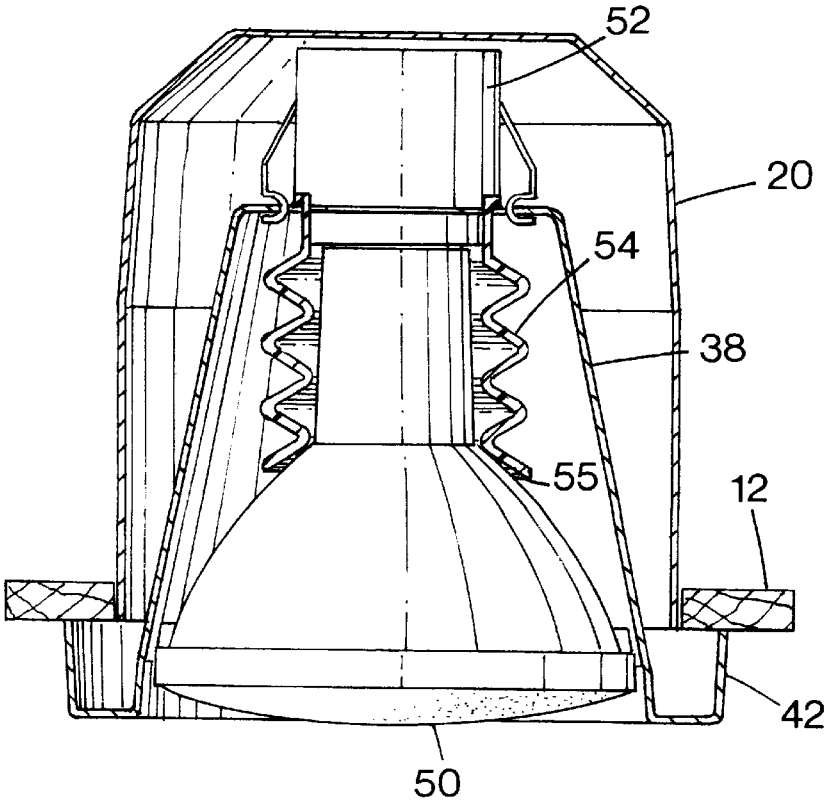
FIG. 7 is a side elevational view in section of a trim useful according to the invention and having an extendible bellows extending between an upper portion of the trim and outer surfaces of the lamp, the extendible bellows adjusting to extend into contact with outer surfaces of the lamp regardless of the length of lamp employed.

Referring now to FIG. 7, a trim is seen which is essentially identical to the trim 38 of FIG. 5, a lamp 50 mounted by a socket 52 which is in turn mounted by the trim 38 being a PAR 30LN lamp. A compressible bellows 54 mounts between the socket 52 and upper top wall portions of the trim 38, the bellows extending into the interior of the trim 38 with lower perimetric edges 55 at the distal end of the bellows 54 engaging exterior wall surfaces of the lamp 50. The bellows 54 is chosen to be compressible and thus extensible in order to accommodate lamps of differing vertical dimension. It is to be seen that the bellows 54 could be configured in a cylindrical conformation and formed of a length which would extend downwardly within the interior of the trim 38 and toward contact with or into contact with exterior surfaces of a lamp such as the lamp 50.

Figure 8:
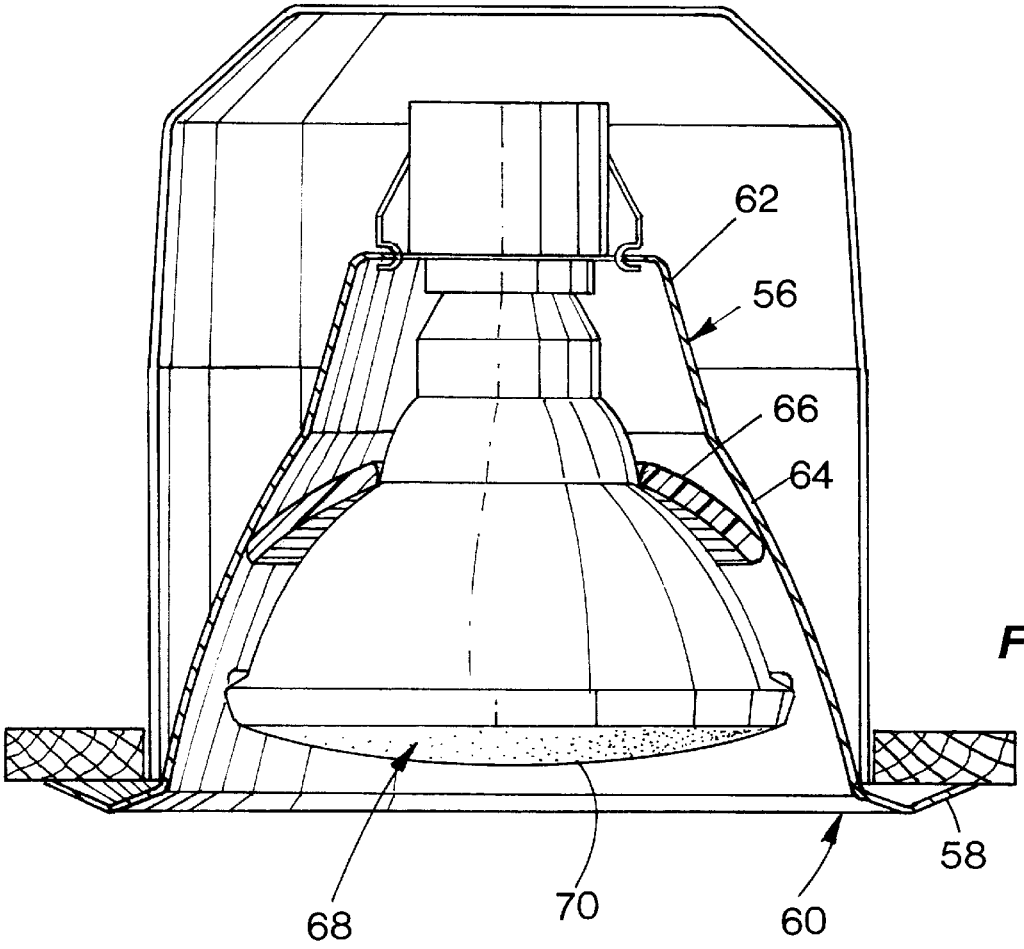
FIG. 8 is a side elevational view in section of a trim useful according to the invention and having a gasket disposed between interior surfaces of the trim and exterior surfaces of the lamp.
Figure 10:
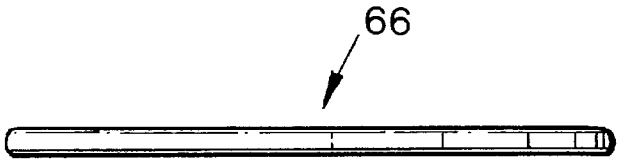

Referring now to FIGS. 8 and 10, a trim 56 is seen to be provided with a flange 58 which is V-shaped in section, the flange extending about perimetric edges of an opening 60. The trim 56 is formed with a frusto-conical upper portion 62 and an arcuate-walled lower portion 64 for efficient reflection of light from within the trim 56 through the opening 60. A gasket 66 such as is seen in a non-deformed conformation in FIG. 10 fits between interior wall surfaces of the trim 56 and exterior wall surfaces of lamp 68, which lamp 68 is preferably chosen to be an indoor/outdoor PAR 38 lamp or a similar lamp rated for wet locations since shower spray within the environment of a shower enclosure such as the shower enclosure 14 of FIG. 1 inter alia would indeed contact the lamp 68 at lower portions thereof such as over the arcuate, distal end 70 of the lamp 68. As seen in FIG. 8, the gasket 66 becomes deformed when fitted between interior surfaces of the trim 56 and exterior surfaces of the lamp 68.

The grommet 48 and the gasket 66 are preferably formed of rubber or similar elastomeric materials. The compressible bellows 54 can be formed of similar material having a desired degree of elasticity in order to produce a desired function when the bellows 52 is intended to be compressible. Formation of the bellows 54 into a cylindrical body of predetermined length will allow formation of the cylindrical structure from any desirable and inexpensive as well as waterproof material whether or not having elasticity or being compressible along its length.

While different embodiments of the invention have been described herein as being useful according to the invention for configuring a lighting fixture for safe use within a shower enclosure, it is to be understood that other structural conformations could readily be devised to provide the function so intended. Similarly, other structure herein explicitly described can be configured other than as expressly shown and described herein. Accordingly, it can be readily understood in view of the particular embodiments of the invention which are expressly described hereinabove that the invention can be formed in a wide variety of configurations without departing from the intended scope of the invention, the scope of the invention being defined by the recitations of the appended claims.

What is claimed is:

1. A lighting fixture for illuminating a shower enclosure having a ceiling, the fixture comprising a recessed downlighting fixture mounted above the ceiling, the ceiling having a ceiling opening formed therein above which the downlighting fixture is mounted, the downlighting fixture mounting a lamp capable of contacting moisture without damage to the lamp whether or not the lamp is illuminating the shower enclosure, electrical components connected to the lamp for energization of the lamp, the lamp being positioned by the downlighting fixture to illuminate the shower enclosure through the ceiling opening, a trim carried by the downlighting fixture and enclosing at least major portions of the lamp and at least portions of the electrical components, at least a portion of the trim extending through the ceiling opening, only that portion of the trim extending into the ceiling opening and lowermost portions of the lamp being visible from within the shower enclosure, the trim having a trim opening communicating with the interior of the shower enclosure, that portion of the trim extending through the ceiling opening positioning the trim opening substantially in or adjacent to the ceiling opening, a portion of the lamp from which light emanates being positioned relative to the trim opening and the ceiling opening to direct light into the shower enclosure, the trim opening being spaced from distal end portions of the lamp to form an annulus therebetween, the annulus comprising a spacing having dimensions sufficient to impede movement of moisture through the annulus and into spaces between interior surfaces of the trim and exterior surfaces of the lamp, the annulus communicating interior portions of the trim with the interior of the shower enclosure without damage to the electrical components due to contact with moisture.

2. The fixture of claim 1 wherein the annulus is of dimensions sufficiently small to effectively inhibit passage of moisture through the annulus, spacing between interior walls of the trim and exterior walls of the lamp reducing vertical momentum of moisture passing through the annulus and contacting said walls to prevent movement of moisture to uppermost portions of the trim and into contact with electrical components of the lighting fixture.

3. The lighting fixture of claim 1 wherein the trim is frusto-conical in shape and has a flange formed perimetrically about the trim opening.

4. The lighting fixture of claim 1 wherein the trim opening has slightly greater dimensions than the dimensions of distal end portions of the lamp extending into or adjacent to the trim opening, the trim opening and shape of the distal end portions of the lamp being congruent.

5. The lighting fixture of claim 4 wherein the trim is frusto-conical in shape and has a flange formed perimetrically about the opening formed in the trim.

6. The lighting fixture of claim 1 wherein the trim and lamp are arranged vertically within the shower enclosure, the trim opening being disposed below other portions of the trim.

* * * * *